US006602108B2

(12) United States Patent
Griffin et al.

(10) Patent No.: US 6,602,108 B2
(45) Date of Patent: Aug. 5, 2003

(54) MODULAR CONTROLLED PLATEN PREPARATION SYSTEM AND METHOD

(75) Inventors: Stephen Griffin, Elk Grove Village, IL (US); David Diaz, Doylestown, PA (US); Douglas A. Seitz, St. Louis Park, MN (US); Robert Passeri, Chicago, IL (US); Ralph Doyle, Palatine, IL (US)

(73) Assignee: Engis Corporation, Wheeling, IL (US)

( * ) Notice: Subject to any disclaimer, the term of this patent is extended or adjusted under 35 U.S.C. 154(b) by 0 days.

(21) Appl. No.: 10/147,357

(22) Filed: May 17, 2002

(65) Prior Publication Data

US 2002/0173233 A1 Nov. 21, 2002

Related U.S. Application Data

(63) Continuation-in-part of application No. 09/542,049, filed on Mar. 31, 2000.

(60) Provisional application No. 60/127,517, filed on Apr. 2, 1999, provisional application No. 60/127,476, filed on Apr. 2, 1999, and provisional application No. 60/127,475, filed on Apr. 2, 1999.

(51) Int. Cl.[7] ..... B24B 49/02

(52) U.S. Cl. ..... 451/5; 451/28; 451/57

(58) Field of Search ..... 451/5, 14, 23, 451/8–10, 28, 56, 270, 272, 339

(56) References Cited

U.S. PATENT DOCUMENTS

| | | | | | |
|---|---|---|---|---|---|
| 2,046,097 | A | | 6/1936 | Summers | 125/11 |
| 3,680,265 | A | | 8/1972 | McClure | 51/131 |
| 3,683,562 | A | | 8/1972 | Day | 51/131 |
| 3,903,653 | A | | 9/1975 | Imhoff et al. | 51/59 R |
| 3,921,342 | A | | 11/1975 | Day | 51/209 DL |
| 4,037,367 | A | | 7/1977 | Kruse | 51/209 S |
| 4,361,595 | A | | 11/1982 | Kaganowicz et al. | 427/39 |
| 4,418,501 | A | | 12/1983 | DeSantis | 51/157 |
| 4,481,741 | A | * | 11/1984 | Bouladon et al. | 451/285 |
| 4,821,461 | A | | 4/1989 | Holmstrand | 51/209 DL |
| 4,866,886 | A | | 9/1989 | Holmstrand | 51/307 |
| 5,107,626 | A | | 4/1992 | Mucci | 51/281 R |
| 5,207,759 | A | | 5/1993 | Mehmandoust et al. | 51/281 SF |
| 5,456,627 | A | * | 10/1995 | Jackson et al. | 451/11 |
| 5,695,384 | A | * | 12/1997 | Beratan | 451/28 |
| 5,713,123 | A | | 2/1998 | Toyoda et al. | 29/603.12 |
| 5,749,769 | A | | 5/1998 | Church et al. | 451/5 |
| 5,810,642 | A | | 9/1998 | Bando | 451/5 |
| 5,816,891 | A | * | 10/1998 | Woo | 451/6 |
| 5,827,111 | A | | 10/1998 | Ball | 451/14 |
| 5,857,898 | A | * | 1/1999 | Hiyama et al. | 451/56 |
| 5,944,580 | A | * | 8/1999 | Kim et al. | 451/9 |
| 6,050,879 | A | | 4/2000 | Dubrovsky et al. | 451/36 |
| 6,074,283 | A | * | 6/2000 | Maeda et al. | 451/53 |
| 6,196,897 | B1 | * | 3/2001 | Suto et al. | 451/8 |

* cited by examiner

*Primary Examiner*—Joseph J. Hail, III
*Assistant Examiner*—Anthony Ojini
(74) *Attorney, Agent, or Firm*—McDermott, Will & Emery

(57) ABSTRACT

A system and method are disclosed for preparing platens to perform lapping operations. The system includes a platter that is rotatably mounted on a base and designed to receive the platen thereon. A main drive motor is provided for rotating the platter and the platen disposed thereon. A plurality of pressure arms are disposed on the base and configured to include a tool receiving portion that can be positioned in alignment with a lapping surface of the platen, and configured to softly touch a tool to a platen. A tool is attached to each tool receiving portion so that predetermined operations can be performed on the lapping surface of the platen. A monitor is provided to monitor predetermined parameters and maintain substantially constant conditions while preparing the platen.

10 Claims, 9 Drawing Sheets

MODULAR CONTROLLED PLATEN PREPARATION SYSTEM AND METHOD

RELATED APPLICATIONS

This application is a continuation-in-part of U.S. patent application Ser. No. 09/542,049 filed Mar. 31, 2000. U.S. patent application Ser. No. 09/542,049 claims priority of: U.S. Provisional Application Ser. No. 60/127,517 filed Apr. 2, 1999; U.S. Provisional Application Ser. No. 60/127,476 filed Apr. 2, 1999; and U.S. Provisional Application Ser. No. 60/127,475 filed Apr. 2, 1999; all of which are hereby incorporated by reference.

BACKGROUND OF THE INVENTION

1. Technical Field

The present invention relates to platen preparation systems and, more particularly, to a system for texturizing and charging a platen that includes the ability to accurately control various system parameters.

2. Description of the Related Art

Lapping machines are commonly used to perform lapping operations on various work materials such as semiconductor wafers, magnetic disk substrates, magnetic head units, etc. Such lapping machines utilize a lapping plate that performs grinding and/or polishing operations on the work material. Current trends for miniaturization and increased capacity of hard disk drives has resulted in the need for materials having a high degree of planarity, while maintaining close tolerances. Consequently, lapping plates used to grind and polish such materials must be constructed with a high degree of precision.

Lapping plates are typically constructed such that one, or both, surfaces contain predetermined concentrations of abrasive materials. The lapping plate is sometimes used in conjunction with a slurry containing abrasive material during the grinding, or lapping, operations. Over time, the abrasive contained in the lapping plate becomes worn, and reduces the effectiveness of the lapping plate. Accordingly, the material and design of the lapping plate are important for improving its useful life, and reducing manufacturing costs.

Various types of materials and methods have been employed for constructing the abrasive surface of lapping plates. For example, the abrasive surface is often formed by embedding diamond particles into the lapping plate in a process known as charging. Diamond particles tend to provide superior resistance to wear due to their hardness properties. The procedure for embedding diamond particles into lapping plates ranges from hand charging with a tool to charging on a lapping machine with various tools. Additionally, metal bonded diamond plated conditioning rings have been used to texturize lapping plates. The conditioning ring typically consists of a metallic ring having one face coated with a monolayer of diamond that is held in place by an electroplated nickel deposit.

There currently exists no systems specifically designed for preparing lapping plates. Current devices are in the form of lapping machines that have been modified for use to prepare a platen for lapping operations. Such devices have drawbacks when used to prepare lapping plates. For example, the process of preparing a lapping plate requires several processing steps, and modifications must be made to the device for each process step. The resulting lapping plate is somewhat deficient because the device cannot be optimized for each process step.

There are various examples in the literature that describe processes for charging lapping plates. For example, U.S. Pat. No. 5,107,626 issued to Mucci describes a method of providing a patterned surface on a substrate using an abrasive article having a specified pattern. The abrasive article includes a backing having at least one abrasive composite bonded thereto. The abrasive composite is in the form of abrasive grains dispersed in a binder and are disposed in a predetermined array consisting of a plurality of peaks and valleys.

U.S. Pat. Nos. 4,866,886 and 4,821,461 issued to Holmstrand both describe a lapping plate that is selectively textured for improved useful life and greater abrading consistency. Glass beads are serially propelled onto a lapping surface of the lapping plate to form spherical cavities of uniform size and distribution, as well as a desired density. The cavities provide discontinuity in the lapping surface which substantially prevents hydroplaning. The cavities also receive loose abrading grit, workpiece fragments, and other contaminants that result in more smoothly machined workpiece surfaces.

There are various other examples of devices for preparing lapping plates. For example, see U.S. Pat. Nos. 3,680,265; 3,903,653; 4,418,501; 5,713,123; and 5,749,769. None of the conventional devices, however, are designed for preparing lapping plates. Consequently, these devices are incapable of optimizing performance of the lapping plate. Additionally, these devices do not minimize the impact of contacting a tool to the surface of a platen.

Accordingly, there exists a need for a platen preparation system that is specifically designed to prepare and, hence, optimize performance of lapping plates. There is also a need to reduce the impact force of a tool upon the surface of a platen in order to minimize damage to the platen surface.

DISCLOSURE OF THE INVENTION

An advantage of the present invention is a platen preparation system that is specifically designed to prepare a platen for performing lapping operations.

This and other advantages are achieved by the present invention wherein a system for preparing a platen for lapping operations includes a mechanism for slowing the descent of a tool towards the surface of a platen in order to lighten the impact of the tool upon the surface of the platen.

According to one aspect of the invention, an apparatus for preparing platens for lapping operations comprises: a base, a platter, a main drive motor, at least one pressure arm, a tool attached to each pressure arm, an actuator coupled to each pressure arm, a mechanism for slowing each pressure arm to reduce impact of the tool on the platen, and a monitor. The platter is rotatably mounted on the base and designed to receive the platen thereon. The main drive motor is attached to the base and operatively coupled to the platter so that the platter, and platen disposed thereon, can be rotated. The pressure arms are disposed on the base and include a tool receiving portion that can be positioned in alignment with the lapping surface of the platen. A tool is attached to each tool receiving portion so that predetermined operations can be performed on the lapping surface of the platen. The actuators place the pressure arms in contact with the lapping surface of the platen, and slow the descent of the tool onto the platen to reduce impact, then apply prescribed pressure levels to perform various operations. During selected operations, the monitor monitors predetermined criteria to maintain substantially constant conditions. According to such a system, a high quality lapping plate can be prepared using a single device. Further, by monitoring certain criteria to maintain constant conditions, lapping plates can be prepared with repeated consistency and quality.

According to another aspect of the invention, a method for reducing impact of a tool upon a platen surface comprises the steps of: lowering the tool; detecting the presence of the tool at a height above the platen surface; and stopping the lowering of the tool based upon detecting the tool at the height above the platen surface.

According to another aspect of the invention, a method for reducing impact of a tool upon a platen surface comprises the steps of: lowering the tool; and initiating stopping lowering the tool based upon initial contact of the tool with the platen surface.

Additional advantages and novel features of the present invention will be set forth in part in the description which follows, and in part will become apparent to those skilled in the art upon examination of the following, or may be learned by practice of the present invention. The embodiments shown and described provide an illustration of the best mode contemplated for carrying out the present invention. The invention is capable of modifications in various obvious respects, all without departing from the spirit and scope thereof. Accordingly, the drawings and description are to be regarded as illustrative in nature, and not as restrictive. The advantages of the present invention may be realized and attained by means of the instrumentalities and combinations particularly pointed out in the appended claims.

BRIEF DESCRIPTION OF THE DRAWINGS

Reference is made to the attached drawings, wherein elements having the same reference numeral designations represent like elements throughout and wherein:

FIG. 10*b* is an enlarged view of the height sensor and pressure arm depicted in FIG. 10*a.

DETAILED DESCRIPTION OF THE PREFERRED EMBODIMENTS

Figure 1:
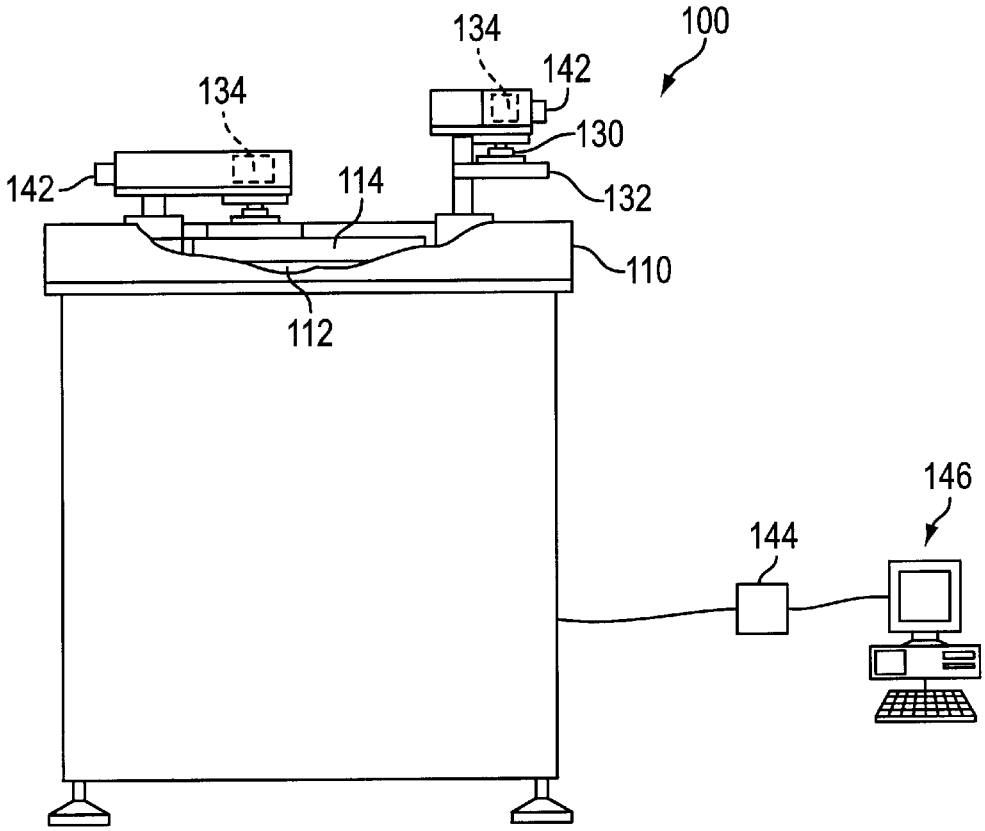
FIG. 1 is an illustration of a platen preparation system constructed in accordance with the present invention.
Figure 3:
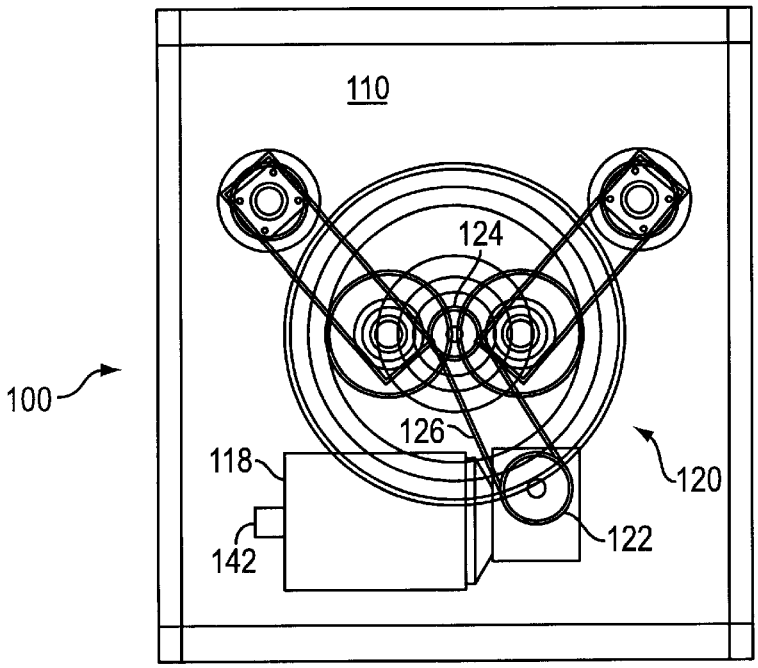
FIG. 3 is a cutaway of FIG. 2 illustrating internal components.

Referring now to the drawings and initially to FIGS. 1 to 4, there is shown a system 100 for preparing lapping plates (i.e., a platen preparation system) constructed in accordance with an aspect of the present invention. The platen preparation system 100 includes a base 110 constructed of rigid or high strength materials. As illustrated in FIG. 1, the base 110 can be mounted on stands, or appropriate support members. A platter 112 is rotatably mounted on the base 110. The platter 112 is designed to receive a platen 114 that will be prepared for performing lapping operations. More particularly, the platen 114 includes one or more lapping surfaces 116 (only one shown) that will be used to perform the actual lapping operations.

Figure 4:
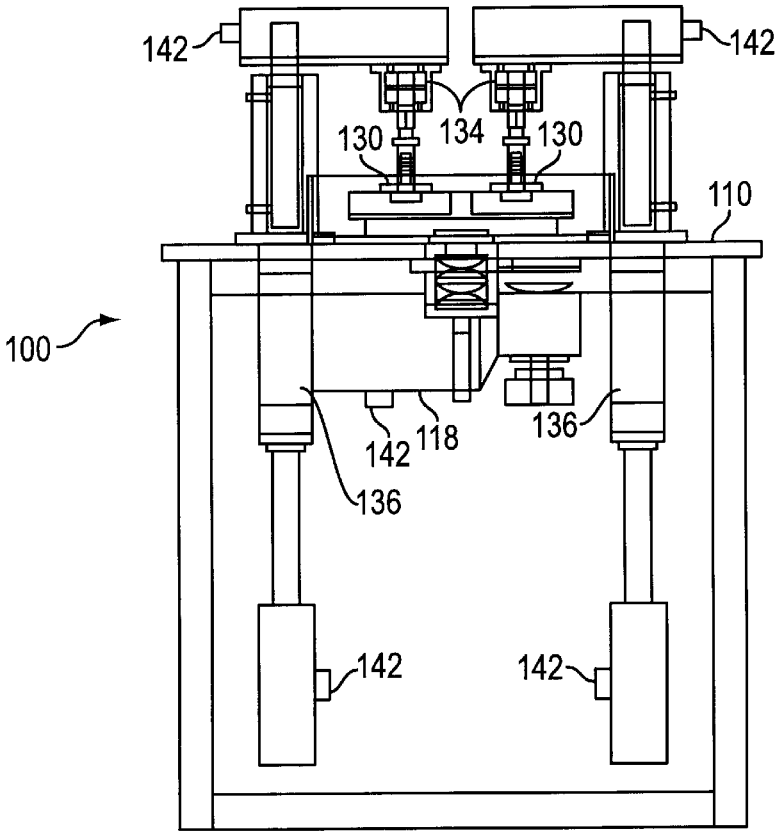
FIG. 4 is front elevational view of the platen preparation system.

A main drive motor 118 is attached to the base 110, as shown in FIG. 4, and provides the force necessary to rotate the platter 112 during operation of the platen preparation system 100. According to the illustrated embodiment of the invention, a spindle assembly 120 is coupled to the main drive motor 118 in order to rotate the platter 112. The spindle assembly 120 includes a first spindle 122 that is attached to the main drive motor 118. A second spindle 124 is connected to the platter 112. A connector 126 such as a closed loop belt is used to transfer rotational motion from the first spindle 122 to the second spindle 124, thereby rotating the platter 112.

The platen preparation system 100 includes a pair of pressure arms 128 disposed on the base 110. Although only two pressure arms 128 are illustrated in the Figures, it should be appreciated that various other configurations are possible. For example, only one pressure arm 128 may be provided, or more than two pressure arms 128 can be provided. Each pressure arm 128 includes a tool receiving portion 130. A tool 132 is attached to each tool receiving portion 130 for performing operations on the lapping surface 116 of the platen 114. Each tool receiving portion 130 is rotatably mounted to its respective pressure arm 128. Each pressure arm 128 further includes a spindle motor 134 that controls rotation of the tool receiving portion 130. According to the disclosed embodiment of the invention, the tool receiving portion 130 can be configured with a quick change arrangement that easily accepts a variety of texturizing and charging tools. The pressure arms 128 are used (in conjunction with the tools 132) to perform texturizing and charging operations on the platen 114 in preparation for lapping operations.

Figure 2:
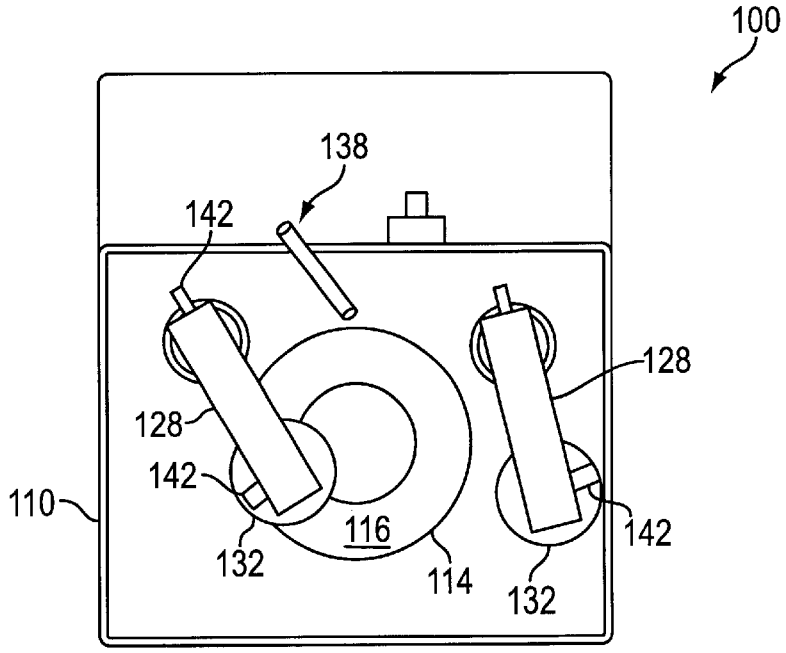
FIG. 2 is a top plan view of the platen preparation system.

According to the illustrated embodiment of the invention, an actuator 136 is coupled to each pressure arm 128. The actuators 136 function to place the tools 132 in contact with the lapping surface 116 of the platen 114. More particularly, the actuators 136 are capable of placing the pressure arms 128 in various operating positions. As shown in FIG. 2, the tool receiving portion 130 can be placed in a first position wherein the tool 132 is in contact with the lapping surface 116 of the platen 114. A second position is also shown wherein the tool 132 has been raised and placed out of alignment with the platen 114. It should be appreciated that the actuators 136 are also capable of placing the tools 132 in any intermediate positions between the two positions illustrated in FIG. 2. By virtue of its mode of operation, the actuators 136 are controllable for placing the tools 132 in contact with the lapping surface 116 of the platen 114 at prescribed pressure levels. By virtue of an arm height sensor and/or a descent control mechanism, the actuators 136 are controllable for initiating a soft contact between the tools 132 and the lapping surface 116 of the platen 114 when a tool 132 is moved into contact with a lapping surface 116. As will be discussed in greater detail below, such an ability provides improved results during certain operations and less impact by a tool 132 onto a lapping surface 116.

The platen preparation system 100 includes a slurry dispensing unit 138 mounted on the base 110. The slurry dispensing unit 138 is used for dispensing controlled quantities of slurry onto the lapping surface 116 of the platen 114. As is well known, the slurry dispensed on the platen 114 is in the form of a fluid containing predetermined concentrations of abrasive particles. The slurry dispensing unit 138 of the present invention can be configured to dispense the slurry in various manners depending on the specific operation being performed. For example, the slurry dispensing unit 138 can be configured to dispense the slurry in a drip fashion onto the lapping surface 116. Alternatively, the slurry can be dispensed in the form of a spray. Such a feature has an advantage of uniformly distributing slurry onto the platen 114 in situations where dripping would cause the slurry to flow off the lapping surface 116. The slurry dispensing unit 138 can be further controlled to either dispense or not dispense slurry for predetermined intervals of time depending on the specific requirements of the operation being performed.

Figure 8:
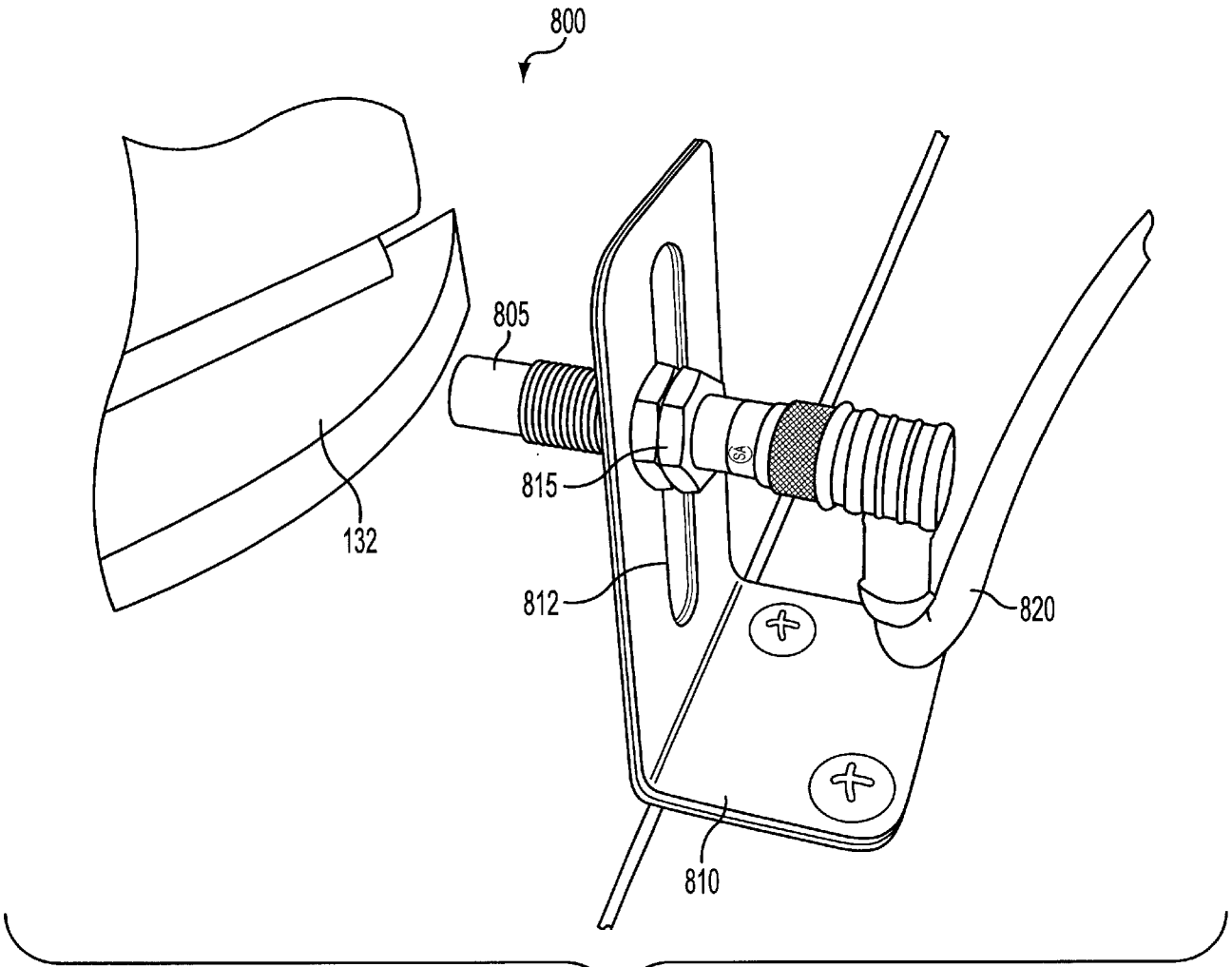
FIG. 8 is an illustration of an arm height sensor of a modular controlled platen preparation system constructed in accordance with the present invention.
Figure 9:
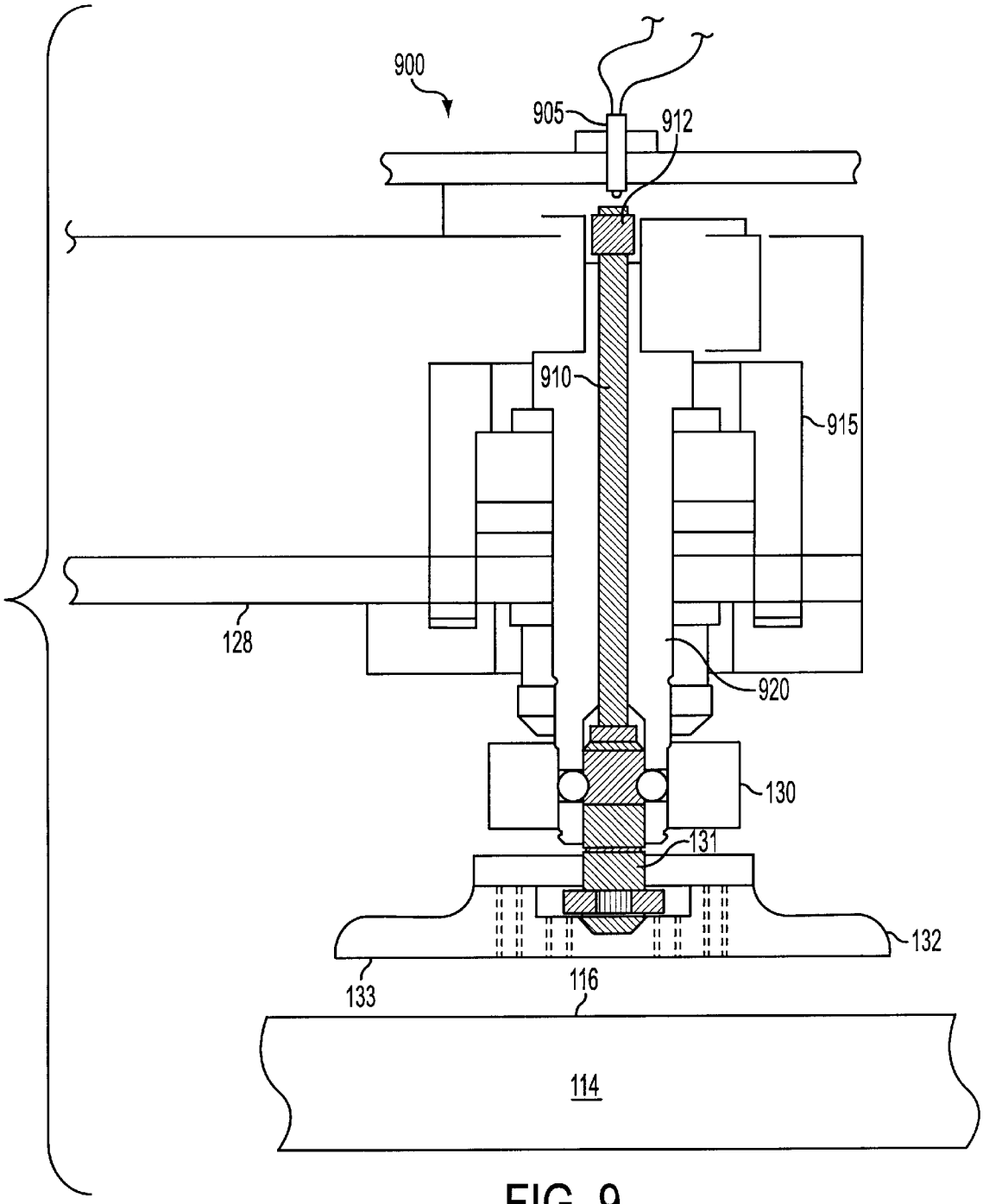
FIG. 9 is an illustration of a descent mechanism of a modular controlled platen preparation system constructed in accordance with the present invention.

The platen preparation system 100 also includes a monitor 140 (see FIG. 5) that continually monitors and controls various functions in order to maintain substantially constant conditions during operations on the platen 114. The monitor 140 includes a plurality of sensors 142 coupled to various components of the platen preparation system 100. Referring to FIGS. 1–5, sensors 142 are coupled to the main drive motor 118, pressure arms 128, actuators 136, and slurry dispensing unit 138. The sensors 142 monitor and control a variety of functions including, but not limited to: the amount of torque generated by the main drive motor 118, rotational velocity of the platter 112, amount of slurry being dispensed, rotational velocity and torque of the spindle motors 134, and amount of pressure generated by the pressure arms 128 on the lapping surface 116. It should be appreciated that additional sensors can be provided to monitor different parameters of the platen preparation system 100. For example, an arm height sensor such as depicted in FIG. 8 provides a reference height of a tool 132 above a lapping surface 116. Another exemplary sensor is a contact switch, such as depicted in FIG. 9, that provides information about when a tool 132 begins to contact a lapping surface 116.

The monitor 140 also includes a control unit 144 that receives and analyzes data collected by the sensors 142 and other sensors as provided. The control unit 144 outputs one or more control signals to control the main drive motor 118, the spindle motors 134, the actuators 136, and the slurry dispensing unit 138. The control unit 144 can include, for example, a processing unit that allows analysis of the data based on pre-programmed conditions in the form of information stored in a data storage portion (not shown). As suggested by the dashed lines shown in FIG. 5, the control signals from the control unit 144 can be routed through different paths depending on the type of sensors 142 used and the manner in which the sensors 142 are connected to individual components. For example, if the selected sensors 142 are connected such that they are only capable of collecting data, then the control unit 144 will output the one or more control signals directly to the individual components. Alternatively, if the selected sensors 142 are connected such that they are capable of both receiving data and controlling their respective components, then the control unit 144 can output the control signals either to the sensors 142 or directly to the individual components.

Figure 5:
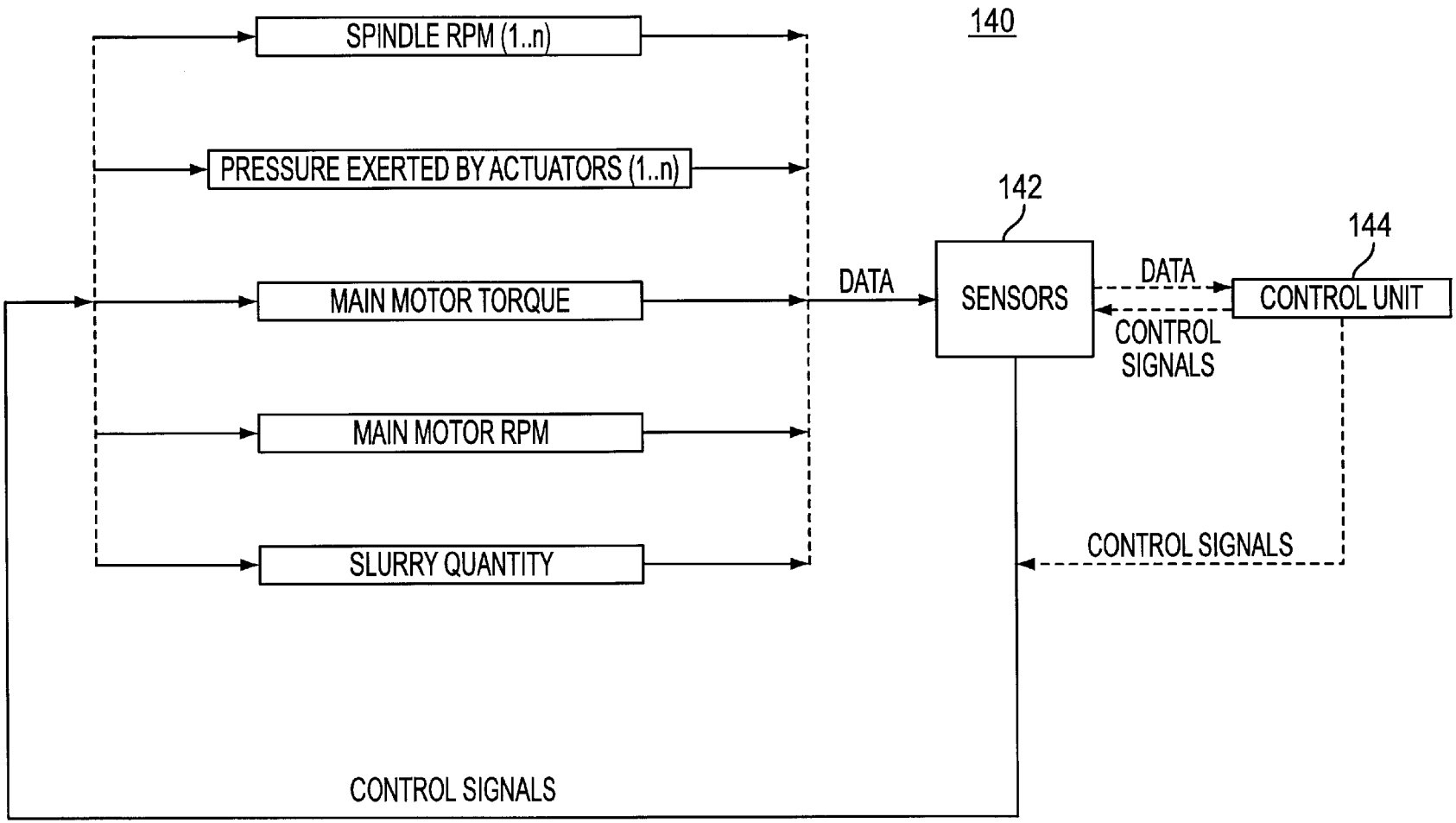
FIG. 5 is a block diagram illustrating the monitor and its operation.

According to an alternative embodiment of the invention, a computer system 146 can be coupled either directly to the sensors 142 or to the control unit 144. When coupled to the sensors 142, the computer system 146 receives and analyzes data in order to control operational parameters of the platen preparation system 100. The computer system 146 can also store data for analysis at a later point in time. When coupled to the control unit 144, the computer system 146 can be used to store data for later analysis, or it can be used in conjunction with the control unit 144 to control operational parameters of the platen preparation system 100. As illustrated in FIG. 5, the monitor 140 operates in a feedback manner. In other words, information is received from the sensors 142 in real-time, and control signals are output responsive to the information received.

Figure 6:
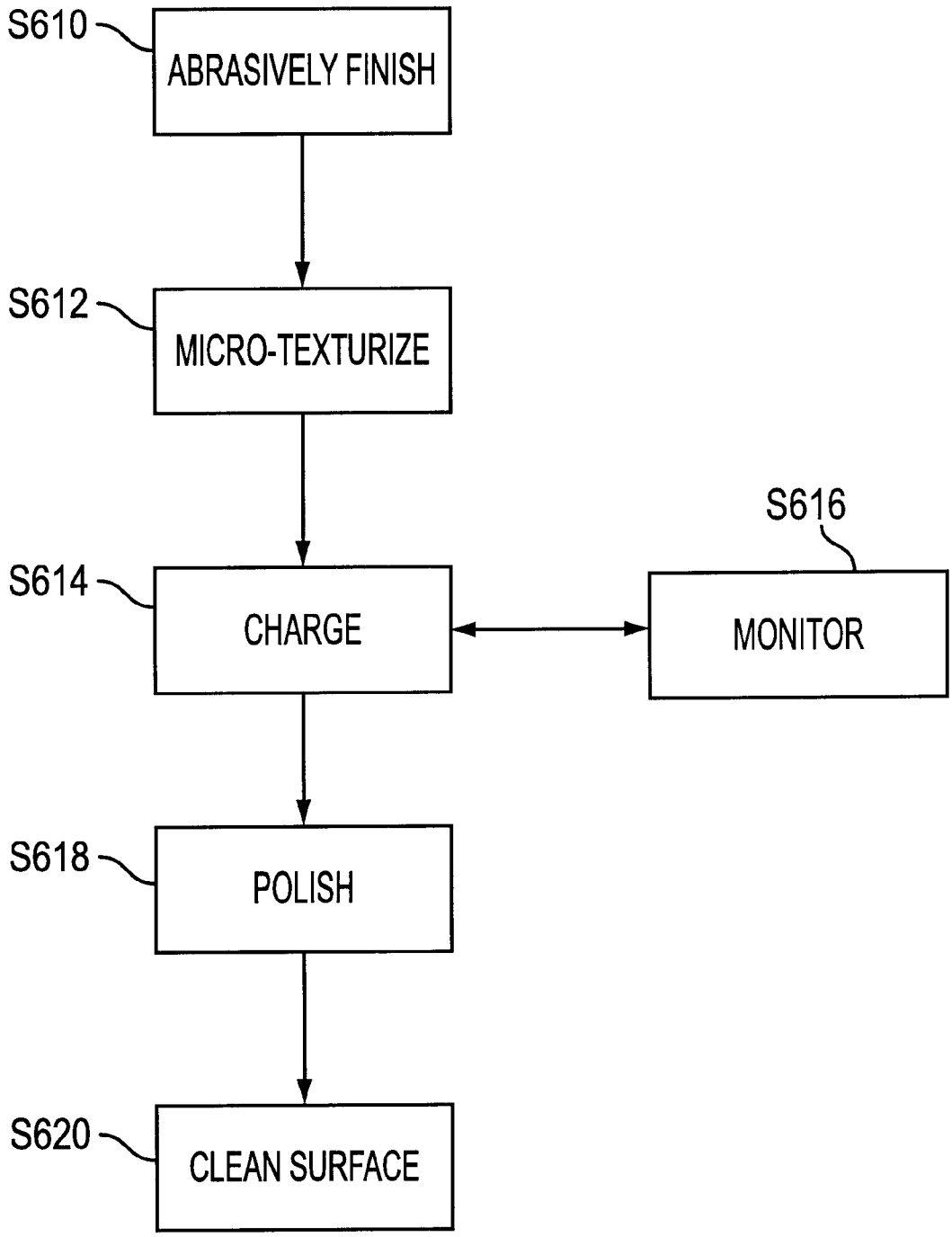
FIG. 6 is a process chart illustrating the steps performed in preparing a platen for performing lapping operations.

Turning now to FIG. 6, a process chart is shown for illustrating the steps performed in preparing a platen 114 for lapping operations, according to an exemplary embodiment of the present invention. While not specifically illustrated, it should be appreciated that the platen 114 must be machined in a pre-step to obtain a desired surface geometry for the lapping surface 116. The pre-step can be performed using the disclosed platen preparation system 110, or it can be performed using specialized machinery. Regardless of how the lapping surface 116 is prepared in the pre-step, the platen 114 must be subsequently placed on the platter 112 for processing.

At step S610, the lapping surface 116 is abrasively finished using one of the pressure arms 128. The abrasive finishing step (S610) corresponds to a conditioning/macro texturizing that removes surface damage and deformation resulting from the pre-step of machining the lapping surface 116. Step S610 utilizes a diamond composite tool to reduce surface area deformation of the lapping surface 116. The diamond composite tool can contain diamond particles having an average size of approximately 3–6 microns. Such tools are manufactured by, and can be easily obtained from, the assignee of the present invention (ENGIS Corporation). Additionally, specialized lubricants can be used depending on the type of tool 132 being used, the material from which the platen 114 is constructed, or both.

According to one embodiment of the present invention, the abrasive finishing can be performed in two steps, namely a first and second texturizing step. The first texturizing step utilizes a diamond composite tool containing diamond particles having an average size of approximately 6 microns. Next, the second texturizing step is performed using a diamond composite tool containing diamond particles having an average size of approximately 3 microns. Depending on the specific materials being used, the second texturizing step can be performed using a diamond composite tool containing diamond particles having an average size of approximately 1 micron. Alternatively, a third texturizing step can be performed using the 1 micron diamond composite tool.

In operation, each tool is allowed to run for a predetermined amount of time. For example, if step S610 is performed in a single step, then the tool can be allowed to run for approximately 5–15 minutes. If step S610 is performed in multiple steps, then each tool is allowed to run for approximately five minutes and then replaced with the next tool of a finer diamond size: 4 micron, 3 micron, or 1 micron. Between each tool exchange, the lapping surface 116 is lightly cleaned to remove residue and prevent damaging surface integrity. A lubricant and/or slurry can be dispensed during step S610. The dosing of a lubricant during the texturizing stage is critical and should be monitored to achieve the best results. If too much lubricant is used the tool 132 will hydroplane, and will not cut efficiently. If too little lubricant is used, the tool 132 will introduce more deformation to the lapping surface 116. Preferably, the monitor 140 is used to control the amount and manner in which the lubricant is dispensed. Alternatively, the slurry dispensing unit 138 can be used to dispense the lubricant under the control of the monitor 140. According to an exemplary embodiment of the invention, an OS type IV lubricant (obtainable from ENGIS Corporation) is used. Other types of lubricants, such as L6364-1V (also obtainable from ENGIS Corporation), can also be used at different dosages. The optimum dosing level is specific for a given lubricant, and must be specifically determined.

At step S612, the lapping surface 116 is micro-texturized. Step S612 creates, in a controlled manner, cavities and raised land areas of generally uniform size, distribution, and density on the lapping surface 116. This can be achieved in several ways. According to one embodiment of the invention, a diamond composite tool containing diamond particles having an average size ranging from approximately 0.1 micron to 1 micron can be used in conjunction with appropriate lubricants. Additionally, slurry can be dispensed on the lapping surface 116. According to another embodiment of the invention, a composite tool can be used in conjunction with a high quality abrasive slurry containing diamond particles having an average size ranging from approximately 0.1 micron to 1 micron. Such slurries can be obtained from the ENGIS Corporation.

At step S614, the lapping surface 116 is charged with diamond particles to form a charged lapping surface. Charging can be defined as the process of embedding a free abrasive (i.e., the diamond particles) suspended in a liquid into the lapping surface 116. Step S614 is performed using a composite diamond tool in combination with a diamond abrasive charging slurry. Specifically, the pressure arms 128 exert pressure on the platen 114 and embed the diamond particles contained in the slurry into the lapping surface 116. Step S614 is preferably performed under constant conditions. Accordingly, rotational velocity of the charging tool, pressure, and slurry concentration must be accurately controlled. It should be appreciated that performance of step S614 need not be limited to the use of a composite diamond tool. Various other tools, such as a ceramic conditioning ring, that are commonly used in texturizing operations can be used in place of the composite diamond tool.

Step S616 monitors various parameters during the charging step (S614) in order to maintain substantially constant conditions on the platen. The monitor 140 monitors and controls these parameter and, as suggested by FIG. 6, performs step S616 substantially simultaneously with step S614. More particularly, the control unit 144 collects data representative of parameters such as the rotational velocity of the tool 132 and platter 112, and pressure and slurry concentration on the lapping surface 116 using the sensors 142. The data is analyzed in real-time and control signals are output to the sensors 142 to control their respective components and maintain substantially constant rotational velocity and pressure on the platen 114.

According to the disclosed embodiment of the invention, step S614 is performed for approximately 15 minutes and utilizes the free abrasive slurry as the only source of diamond particles for charging the lapping surface 116. Further, it is not necessary to provide any additional lubricant beyond that contained in the slurry. The rotational speed of the tool is preferably maintained at a slow speed of, for example, about 30 RPM, to allow the diamond particles to become fully embedded within the lapping surface 116. It should be noted, however, that other values may be selected for the rotational velocity based on other real-time conditions such as the pressure exerted by the pressure arms 128.

At step S618, the lapping surface 116 is polished to uniformly expose the diamond particles that were embedded during the step S614. Specifically, a fine abrasive is used to remove deformation resulting from charging, and fully expose the diamond abrasive for subsequent lapping operations. Step S618 is performed in two parts using a chemical mechanical polishing (CMP) process in combination with a special chemical solution. The chemical solution preferably has a high pH concentration. The chemical solution is dispensed on the lapping surface 116 in a drip fashion. The first part of the polishing step (S618) is performed using a perforated polishing pad (not shown) attached to the tool receiving portion 130 in a first CMP process. Next, a second CMP process is performed using a low nap cloth attached to the tool receiving portion 130. The chemical solution is preferably selected to be product number MECH CHEM 6391-1, which can be obtained from the ENGIS Corporation. Further, the chemical solution is applied at a rate of about 1.33 oz. per minute. In operation, each CMP process (i.e., using the perforated polishing pad and the nap cloth) is preferably performed for about five minutes. The lapping surface 116 is then immediately cleaned, at step S620, to prevent formation of insoluble oxides or glassy phases that commonly form during the drying of the closing silicon. At this point, the platen 114 is ready to perform lapping operations.

For the above processing steps, certain embodiments of the present invention provide a soft touch of the tool 132 onto the lapping surface 116. Referring to FIGS. 1 and 2, it is seen that when a tool 132 is not in use for performing an operation on a lapping surface 116, the actuator 136 moves pressure arm 128 to a position where the tool 132 is placed out of alignment with the platen 114 both horizontally and vertically. When pressure arm 128 is moved by actuator 136 to place a tool 132 into contact with a lapping surface 116 on platen 114 it is desirable for tool 132 to contact lapping surface 116 with minimal impact, i.e. a soft touch, in order to prevent impact damage to the lapping surface 116.

Referring to FIGS. 2, 4, 8, 10*a* and 10*b*, in a further embodiment of the present invention, an arm height sensing device 800 is utilized to provide a reference height of the tool 132 above the lapping surface 116 in the apparatus described. Knowing the height of the tool 132 above the lapping surface 116 permits braking of pressure arm 128's descent in time to reduce the impact of tool 132 upon lapping surface 116.

Figure 10A:
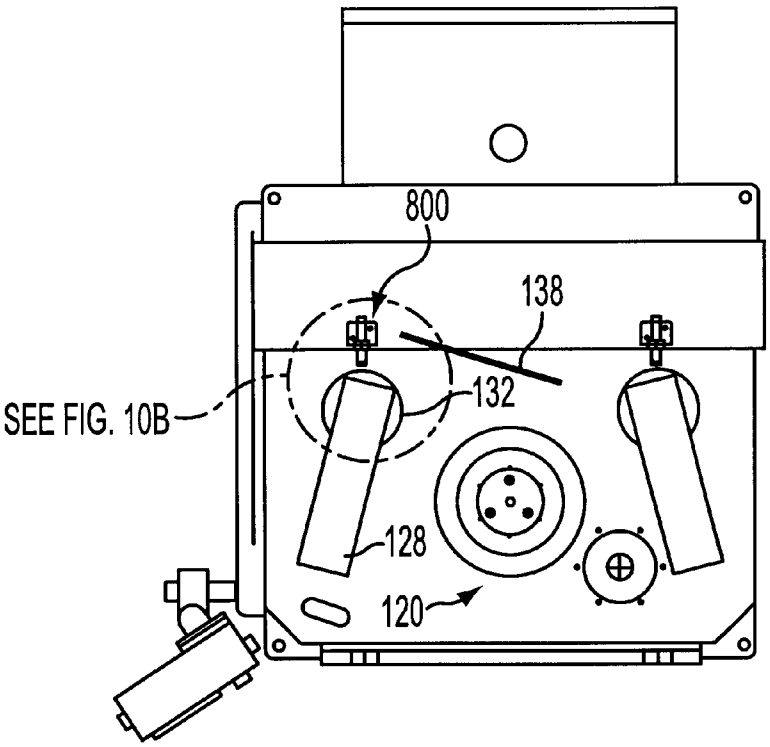
FIG. 10*a* is an illustration of a platen preparation system equipped with a descent mechanism and equipped with an arm height sensor constructed in accordance with the present invention.
Figure 10B:
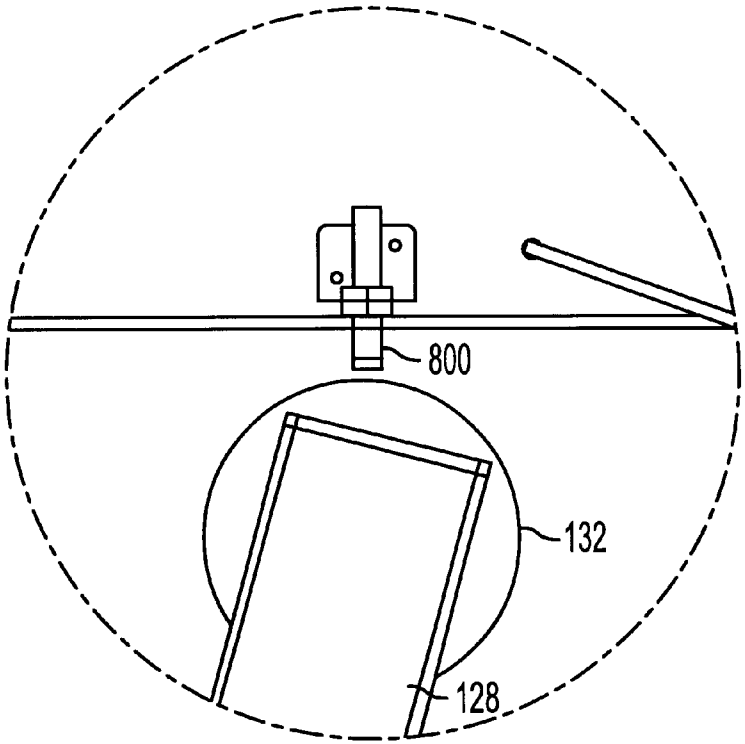

Actuator 136 moves pressure arm 128 so that tool 132 is placed horizontally near the arm height sensing device 800, see FIG. 10*b*. After the actuator 136 has moved pressure arm 128, and thus tool 132, near the arm height sensing device 800, the actuator 136 lowers pressure arm 128, and thus tool 132. When the arm height sensing device 800 detects tool 132, actuator 136 brakes pressure arm 128 so that tool 132 stops at a known height. Braking by actuator 136 can be initiated directly from a signal from the arm height sensing device 800, or can be initiated by controller 144 and/or computer system 146 (see FIG. 1) in response to a signal from arm height sensing device 800.

In certain embodiments of the present invention, arm height sensing device 800 comprises a metal proximity sensor 805 that is activated when a metal object is placed in front of the sensor 805. Other sensors, for example, an optical sensor, can be used to sense the presence of tool 132 at a determined height, i.e., the height of the sensor. As tool 132 (which comprises, for example, a metal disc) is lowered, it activates the metal proximity sensor 805 which sends a signal, for example over connector 820, to actuator 136, or to controller 144 and/or computer system 146. In response, actuator 136, or controller 144 and/or computer system 146, causes braking of actuator 136 to slow and stop the descent of tool 132 in a conventional manner so that tool 132 is vertically aligned with the metal proximity sensor 805.

Because the height of the metal proximity sensor 805 above the lapping surface 116 is known, a reference height for the tool 132 above the lapping surface 116 can be established. Establishing the reference height for the tool 132 above the lapping surface 116 can simply be equated to the height of the sensor 805, or can be calculated by the controller 144 and/or computer system 146 based upon the height of the sensor 805 and/or the descent speed and braking time of the pressure arm 128.

Once the reference height of the tool 132 has been established the actuator 136 moves pressure arm 128 to position the tool 132 horizontally above the platen 114. By knowing the reference height of the tool 132 above the lapping surface 116, the control unit 144 and/or computer system 146 is able to cause actuator 136 to lower the tool 132 into contact with the lapping surface 116, initiating a braking action upon the actuator 136 with sufficient time to slow the descent of the tool 132 so that tool 132 is moving slowly just prior to impacting the lapping surface 116. The reference height established by the arm height sensor 800 also ensures that the descent of tool 132 is not arrested too soon resulting in tool 132 coming to a stop while still above lapping surface 116.

Preferably, the height of the arm height sensor, for example a metal proximity sensor 805, is adjustable to permit adjustment of the height at which tool 132 is stopped prior to being moved over platen 114. In the exemplary embodiment of an arm height sensor 800, a bracket 810 is secured to platen preparation system 100 and configured to adjustably hold sensor 805. Two nuts 815 on a threaded portion of sensor 805 are used to lock and unlock the sensor 805 with respect to bracket 810. This arrangement allows the height of sensor 805 to be adjusted along the distance of slot 812.

Adjustment of the reference height of tool 132 above lapping surface 116 allows optimization of the known distance that tool 132 is lowered onto lapping surface 116. Such optimization ensures that the tool 132 has sufficient speed to reach lapping surface 116 under the braking action initiated by controller 144 and/or computer system 146, and also ensures that there is sufficient time for the braking action to slow the descent of tool 132 onto lapping surface 116.

For example, without knowing the height of a tool 132 above a lapping surface 116 the actuator 136 merely lowers tool 132 onto platen 114, impacting the lapping surface with approximately 25 to 30 pounds of force which causes damage to the lapping surface 116 such as gouging. However, utilizing a reference height for a tool 132 above lapping surface 116, the controller 144 and/or computer system 146 control actuator 136 to initiate braking of pressure arm 128, e.g., after a set period of time, so that tool 132 impacts lapping surface 116 with approximately 2 to 10 pounds of force, and preferably 4 to 5 pounds of force, which minimizes or eliminates impact damage to lapping surface 116.

Another manner of using an arm height sensor 800 stops the tool 132 on the lapping surface 116. When the tool 132 triggers sensor 805 actuator 136 begins to stop the pressure arm 128 from moving downward. Instead of having the tool 132 stop at a reference height, the height of the sensor 805 is set so that braking results in slowing tool 132, but permits tool 132 to contact lapping surface 116. By adjusting the height of sensor 805, a starting point for braking can be found that slows pressure arm 128 to the point where tool 132 impacts lapping surface 116 with 2 to 10 pounds of force, and preferably 4 to 5 pounds of force.

Referring to FIGS. 9 and 10, a descent control device 900 is utilized to retard vertical motion of a tool 132 onto lapping surface 116. The exemplary descent control device 900 is configured to begin slowing the descent of pressure arm 128 as soon as the tool 132 contacts the lapping surface 116 in order to minimize impact damage to lapping surface 116.

Actuator 136 (not shown) positions pressure arm 128 and tool 132 horizontally over platen 114 and then lowers pressure arm 128 towards platen 114. When the tool 132 contacts lapping surface 116 a contact switch 905 is triggered and transmits a signal to begin braking pressure arm 128.

In the example depicted in FIG. 9, tool 132 is connected to the tool spindle assembly 915 via drive pin 131 which is retained by tool receiving portion 130, e.g., a quick release assembly. The tool receiving portion 130 retains drive pin 131 in such a manner as to permit vertical movement of drive pin 131, and thus tool 132, in relation to the tool spindle assembly 915.

A contact switch rod 910 is retained within a hollow portion of spindle shaft 920. A collar 912 at one end of contact switch rod 910 prevents contact rod 910 from slipping out of the spindle shaft 920 when no tool 132 is retained by tool receiving portion 130. When a tool 132 is retained in tool receiving portion 130, one end of the contact switch rod 910 rests on top of drive pin 131, thus the contact switch rod 910 moves vertically with the drive pin 131 and tool 132 in relation to the tool spindle assembly 915. The contact switch rod 910 is dimensioned so that contact switch rod 910 is easily vertically displaced in relation to hollow spindle shaft 920.

A contact switch 905 is positioned on pressure arm 128 so that the contact switch 905 is directly above the contact rod 910. When the lower surface 133 of tool 132 contacts lapping surface 116, the downward pressure exerted by the weight of tool 132 upon the tool spindle assembly 915 is relieved. This causes the drive pin 131 to be displaced vertically in relation to the tool spindle assembly 915, which in turn causes contact switch rod 910 to be displaced vertically in relation to the tool spindle assembly 915.

Contact switch rod 910 triggers contact switch 905 while there is still space between tool 132 and the tool receiving portion 130 to allow tool 132 to move vertically in relation to tool receiving portion 130, and thus in relation to tool spindle assembly 915 and pressure arm 128. Triggering contact switch 905 sends a signal to controller 144 and/or computer system 146. Alternatively, a signal from contact switch 905 could be sent directly to actuator 136 to begin braking arm 128. Controller 144 and/or computer system 146 utilize the signal from contact switch 905 to initiate braking of the downward motion of pressure arm 128 by actuator 136.

As there is still space for vertical motion between tool 132 and tool receiving portion 130, the braking action of actuator 136 causes retardation of the downward motion of pressure arm 128 before pressure arm 128 causes a heavy impact upon lapping surface 116. Thus, pressure arm 128 is slowed so that the resulting impact upon lapping surface 116 is approximately 2 to 10 pounds of force, and preferably 4 to 5 pounds of force.

Preferably, the contact switch 905 is mounted such that the distance between the contact switch 905 and the top of contact switch rod 910 when contact switch rod 910 is resting on a drive pin 131 is adjustable. This allows optimization of the distance that the contact switch rod 910 moves prior to triggering the contract switch 905. Optimizing the distance between contact switch rod 910 and contact switch 905 prevents braking pressure arm 128 too early, resulting in stopping pressure arm 128 while there remains a gap between tool 132 and tool receiving portion 130. Optimizing the distance between contact switch rod 910 and contact switch 905 also prevents braking pressure arm 128 too late, resulting in a hard impact upon lapping surface 116.

Figure 11:
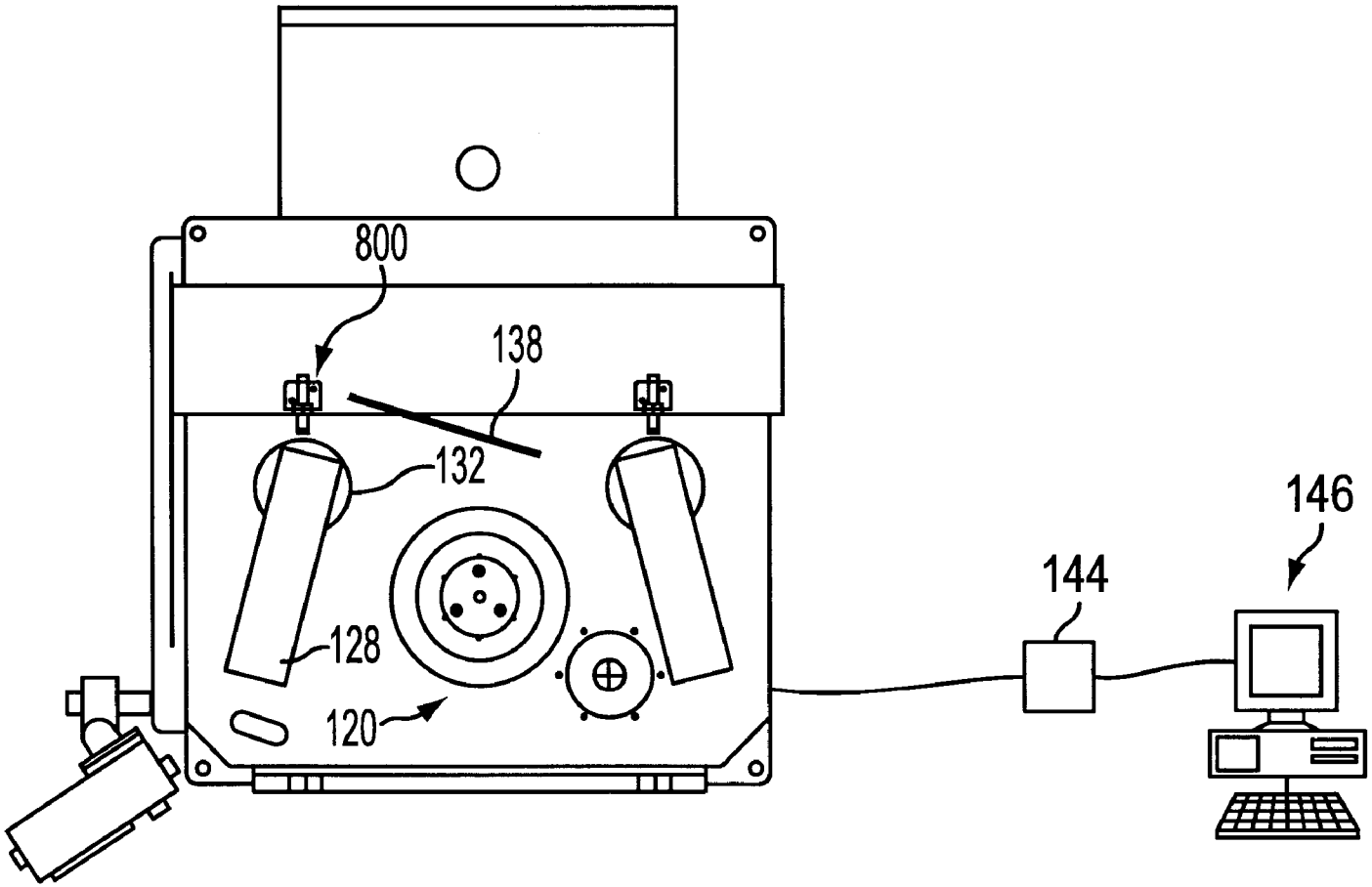
* and FIG. 11 is a view of a platen preparation system according to an embodiment of the present invention having a descent control mechanism and an arm height sensor.

In another embodiment of the present invention, an arm height sensor is utilized in conjunction with a descent control mechanism. Such an arrangement, as depicted in FIG. 11, allows controller 144 and/or computer system 146 to begin braking the downward descent of pressure arm 128 prior to contact between the tool 132 and lapping surface 116 and to increase or decrease the braking pressure as needed based upon when the contact switch 905 is triggered by the contact switch rod 910.

Figure 7:
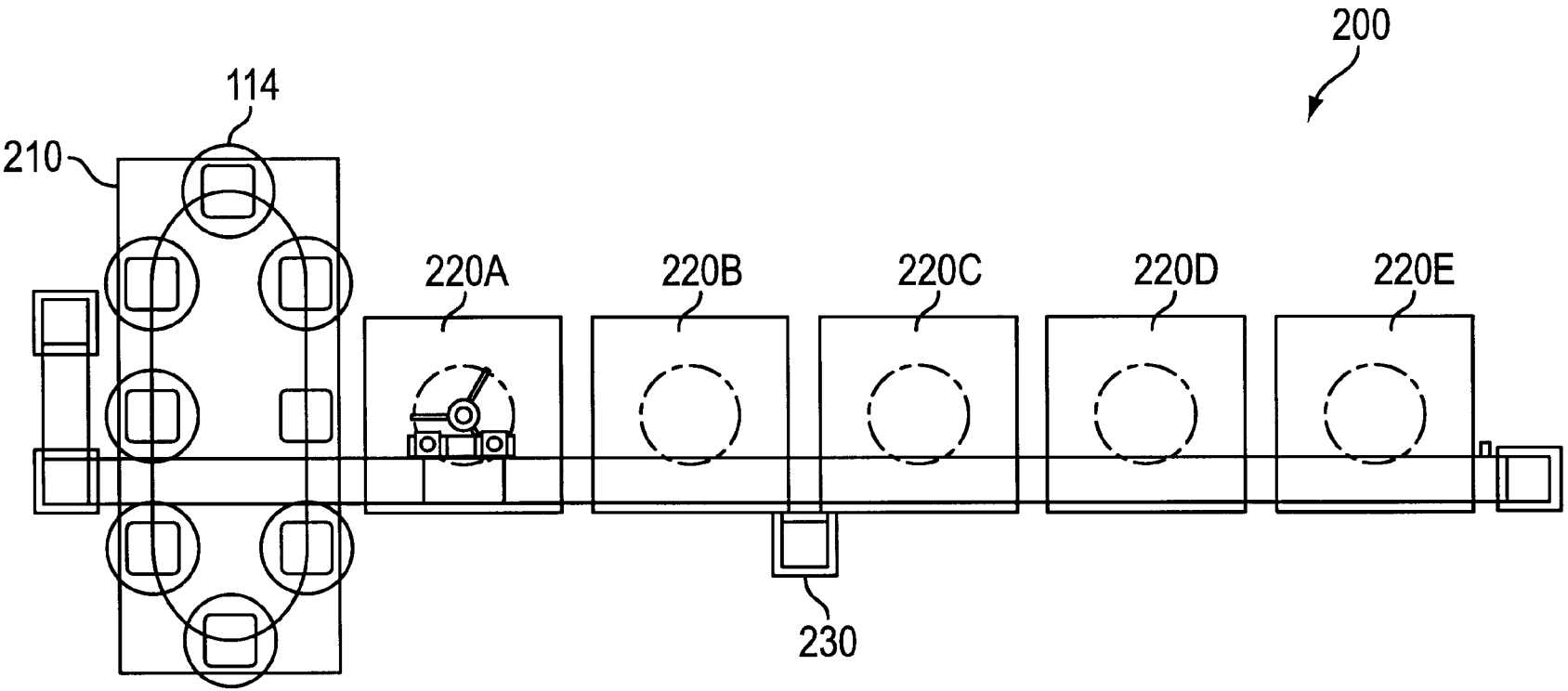
FIG. 7 is an illustration of a modular controlled platen preparation system constructed in accordance with the present invention.

The platen preparation system of the present invention can be configured to automatically prepare one or more platens for performing lapping operations. FIG. 7 illustrates a modular controlled platen preparation system 200 constructed in accordance with an embodiment of the present invention. The modular platen preparation system 200 includes a storage unit 210, a plurality of platen preparation apparatus 220A–220E (collectively 220), and an automatic loader 230. The modular platen preparation system 200 illustrated in FIG. 7 is designed to automatically prepare multiple platens for lapping operations.

The storage unit 210 is configured for storing one or more platens 114 that will be prepared for lapping operations. Each platen preparation apparatus 220 is constructed similar to the platen preparation system 100 described with respect to FIGS. 1–6. However, each of the platen preparation apparatus 220 is equipped with only one specific tool, and restricted to performing a dedicated operation such as, for example, texturizing, charging, etc.

According to the exemplary embodiment illustrated in FIG. 7, the modular platen preparation system 200 includes five platen preparation apparatus 220. Apparatus 220A is configured for machining the lapping surface of the platen 114. This corresponds to the pre-step previously described. Apparatus 220B is configured for texturizing the lapping surface of the platen. This can, under certain embodiments, include both abrasive finishing and micro-texturizing. Alternatively, one platen apparatus 220 can be provided to abrasively finish the platen 114, while another platen preparation apparatus 220 can be provided to micro-texturize the platen 114. Apparatus 220C–220E are configured for charging the lapping surface of the platen 114. It should be noted, however, that three platen preparation apparatus 220C–220E are not necessary for charging the lapping surface of the platen 114. Depending on the specific implementation of the invention, only one platen preparation apparatus 220 may be provided to charge the lapping surface platen 114.

The automatic loader 230 is operatively coupled to the storage unit 210 and the plurality of platen preparation apparatus 220. According to the disclosed embodiment of the invention, the automatic loader 230 physically moves the platens 114 from the storage unit 210 to each platen preparation apparatus 220, and back to the storage unit 210. More particularly, the storage unit 210 initially stores all of the platens 114 that will be prepared. During normal operations, the automatic loader 230 moves a first platen from the storage unit 210 onto the first platen preparation apparatus 220A for machining. Next, the automatic loader 230 moves the first platen from the first platen preparation apparatus 220A onto the second platen preparation apparatus 220B for texturizing. This procedure is repeated until the first platen has been operated on by each of the platen preparation apparatus 220. Finally, the automatic loader 230 will move the first platen back to the storage unit 210. These steps are repeated until all the platens 114 initially stored in the storage unit 210 have been prepared for lapping operations.

According to one embodiment of the invention, the modular platen preparation system 200 is optimized by simultaneously operating each of the platen preparation apparatus 220. According to such an embodiment, after the first platen has been moved from the first platen preparation apparatus 220A to the second platen preparation apparatus 220B, the automatic loader 230 retrieves a subsequent platen for placement on the first platen preparation apparatus 220A. As the first platen is moved to subsequent platen preparation apparatus 220, the remaining platens are also moved to subsequent platen preparation apparatus 220. At this point, the first platen preparation apparatus 220A becomes available, and an additional platen can be retrieved from the storage unit by the automatic loader 230 and placed on the first platen preparation apparatus 220A. It should be appreciated that the modular platen preparation system 200 includes the ability to track the number of platens initially stored in the storage unit 210, as well as the number of platens that have been returned to the storage unit 210. Such an ability advantageously prevents the platens that have been returned to the storage unit 210 from being moved back to the first platen preparation apparatus and unnecessarily operated on. Such an ability also eliminates the requirement of having to manually input the number of platens stored in the storage unit 210 for tracking purposes.

The platen preparation system of the present invention automates the process of embedding diamond particles, (including sub micron particles) in a controlled manner that will produce repeatable and consistent lapping performance characteristics, but can also be controlled to be stopped at any step or stage for preparing a consistent quality controlled macro/micro texture or surface roughness on a lapping surface of the platen. The platen preparation system of the present invention also provides a soft touch for initial contact between a tool and a platen surface to minimize damage caused by impacting the tool upon the platen.

In the previous descriptions, numerous specific details are set forth, such as specific materials, structures, processes, etc., in order to provide a thorough understanding of the present invention. However, as one having ordinary skill in the art would recognize, the present invention can be practiced without resorting to the details specifically set forth. In other instances, well known processing structures have not been described in detail in order not to unnecessarily obscure the present invention.

Only the preferred embodiment of the invention and an example of its versatility are shown and described in the present disclosure. It is to be understood that the invention is capable of use in various other combinations and environments and is capable of changes or modifications within the scope of the inventive concept as expressed herein.

What is claimed is:

1. An apparatus for preparing a platen for performing lapping operations, comprising:

a base;

a platter rotatably mounted on the base;

a main drive motor attached to the base and operatively coupled to the platter;

a pressure arm disposed on the base, the pressure arm including a tool receiving portion capable of being positioned in alignment with a lapping surface of a platen;

an actuator coupled to the pressure arm; and a mechanism for slowing the pressure arm to reduce an impact force resulting from touching a tool to the lapping surface of the platen.

2. The apparatus of claim 1, wherein the mechanism for slowing the pressure arm comprises an arm height sensing device.

3. The apparatus of claim 2, wherein the arm height sensing device comprises:

a metal proximity sensor; and a mounting structure for holding the metal proximity sensor above the lapping surface of the platen.

4. The apparatus of claim 3, wherein the mounting structure adjustably holds the metal proximity sensor at varying heights above the lapping surface of the platen.

5. The apparatus of claim 2, wherein the arm height sensing device comprises:

an optical sensor; and a mounting structure for holding the metal proximity sensor above the lapping surface of the platen.

6. The apparatus of claim 5, wherein the mounting structure adjustably holds the optical sensor at varying heights above the lapping surface of the platen.

7. The apparatus of claim 1, wherein the mechanism for slowing the pressure arm comprises a descent control device.

8. The apparatus of claim 7, wherein the descent control device comprises:

a spindle shaft slidably contained within the pressure arm and adapted to be connected to a tool; and a switch triggered by vertical movement of the spindle shaft.

9. The apparatus of claim 8, wherein the descent control device further comprises:

a hollow portion in the spindle shaft; and a rod slidably mounted within the hollow portion of the spindle shaft and configured to contact a tool;

wherein the switch is triggered by vertical movement of the rod in relation to the spindle shaft.

10. An apparatus for preparing a platen for performing lapping operations, comprising:

a base;

means for rotating a platen mounted on the base;

means disposed on the base for applying a tool to a lapping surface of a platen; and means for slowing the means for applying a tool to a lapping surface of a platen to reduce an impact force resulting from touching a tool to the lapping surface of the platen.

* * * * *